US010155261B2

(12) United States Patent
Chen

(10) Patent No.: US 10,155,261 B2
(45) Date of Patent: Dec. 18, 2018

(54) METHOD FOR FORMING A WRENCH END

(71) Applicant: Ming-Chang Chen, Kaohsiung (TW)

(72) Inventor: Ming-Chang Chen, Kaohsiung (TW)

( * ) Notice: Subject to any disclaimer, the term of this patent is extended or adjusted under 35 U.S.C. 154(b) by 0 days.

(21) Appl. No.: 15/598,581

(22) Filed: May 18, 2017

(65) Prior Publication Data

US 2018/0333771 A1 Nov. 22, 2018

(51) Int. Cl.
*B21K 5/16* (2006.01)
*B22F 3/10* (2006.01)
*B25B 13/08* (2006.01)

(52) U.S. Cl.
CPC ..... *B21K 5/16* (2013.01); *B25B 13/08* (2013.01)

(58) Field of Classification Search
CPC ..... B21K 5/16; B25B 13/08; B22F 3/1017; B22F 3/24; B22F 2005/002; B22F 2998/10
USPC ..... 76/114
See application file for complete search history.

(56) References Cited

U.S. PATENT DOCUMENTS 4,061,013 A * 12/1977 Kuc ..... B21K 5/16 72/353.2
6,240,813 B1 * 6/2001 Hyatt ..... B21K 5/16 81/124.6
9,925,581 B2 * 3/2018 Lin ..... B21K 5/16
2003/0056622 A1 * 3/2003 Jordan ..... B21J 5/12 81/53.2
2006/0185476 A1 * 8/2006 Lin ..... B21K 5/16 76/114
2016/0158827 A1 * 6/2016 Chen ..... B21K 5/16 76/119
2016/0236266 A1 * 8/2016 Chen ..... B21K 5/16
2017/0056962 A1 * 3/2017 Lin ..... B21K 5/16

* cited by examiner

*Primary Examiner* — Omar Flores Sanchez
(74) *Attorney, Agent, or Firm* — Rosenberg, Klein & Lee

(57) ABSTRACT

A method for forming a wrench end includes the steps of preparing a flat blank, initially press-forging at least one end of the blank to form a head with a wrench-shaped part and a hole on the blank, bending the head to form a curved section and a stretched section which are bent at different angles, and shaping the head by holding the curved section and the stretched section with a gripping apparatus and then pressing the hole of the head with a punch in order to subject the two sections to a squeezing force whereby the sections can have a denser interior structure and facilitate a final shaping of the head. The method facilitates a quick shaping of the wrench end and increases the efficiency of forming a wrench product.

4 Claims, 5 Drawing Sheets

METHOD FOR FORMING A WRENCH END

BACKGROUND OF THIS INVENTION

1. Field of this Invention

This invention relates to a forming method and relates particularly to a method for forming a wrench end.

2. Description of the Related Art

Referring to FIG. 1, a traditional method 2 for forming a wrench is carried out by cold forging and includes a preparing step, a head forming step, a stamping step and a removing step. The preparing step is performed by preparing a round metal blank b. The head forming step is executed by cold-forging two ends of the round metal blank b with a press (not shown) to form two round heads b1. The stamping step is performed by pressing the round metal blank b having two round heads b1 with a stamping press (not shown) whereby the round metal blank b is formed into a flat blank having a wrench outline. The removing step is executed by removing residual material from the peripheral edge of the wrench outline of the flat blank with another stamping press (not shown). Therefore, a finished wrench S2 is done. This traditional method needs to form two round heads firstly and then press the heads respectively with a punch to form respective holes on the heads. It also requires a further step for removing residual material. Generally, the traditional method requires complex steps and needs to use multiple presses for completing the processing work, with the result that the processing time is prolonged, the processing efficiency is reduced, and the cost for forming the wrench is increased. Therefore, the traditional method needs improvement.

SUMMARY OF THIS INVENTION

An object of this invention is to provide a method for forming a wrench end quickly and increasing the efficiency of processing and forming the wrench.

The method of this invention includes a step of preparing a flat blank, a step of initially press-forging at least one end of the flat blank to divide the flat blank into a head which is pressed to form both of a wrench-shaped part and a hole and a shank extending outwards from the head, a step of bending the head so that the head can be inclined to the shank and form a curved section and a stretched section bent by different angles at two opposite side surfaces where the head and the shank are joined, and a step of shaping the head to complete a shaped appearance. This shaping step is performed by holding the two sections of the head in place with a gripping apparatus and using a punch to press the hole of the head, thereby squeezing the curved section and the stretched section enclosed by the gripping apparatus gradually when the punch presses the hole to provide a denser interior structure for the sections. Accordingly, the curved section, the stretched section and the hole are well shaped to present a final shaped appearance on the head.

The successive steps, as aforementioned, can facilitate a concurrent shaping of the wrench-shaped part and the hole on the head of the blank and can be distinguished in comparison with the traditional method which requires the steps of forming the wrench outline and hole in sequence and finally removing residual material from the outline. Therefore, the efficiency of processing the wrench is largely promoted. The shaping step as claimed can subject the partial surface of the head whose shape is changed by bending to a squeezing force whereby the interior structure of the portions of the head, namely the bent parts, comes together to provide a denser performance and the quality of the shaped wrench becomes better.

Preferably, in one embodiment, the initially press-forging step can be performed by press-forging two ends of the flat blank at the same time, thereby forming two opposite heads with respective wrench-shaped parts and holes on the flat blank. Subjecting the two heads to a bending action can also be allowed to provide the heads with respective curved sections and stretched sections bent at different angles. In case of two heads, the curved section and stretched section of each head can be enclosed and held by the gripping apparatus and then be gradually squeezed under a pressing force of the punch imparted to the hole of each head. Therefore, the change in the interior structure of the curved sections and the stretched sections can be incurred to provide a denser arrangement which allows the curved sections, the stretched sections and the holes to be well shaped in order to increase the quality of the formed wrench.

The advantages of this invention are more apparent upon reading the following descriptions in conjunction with the drawings.

DETAILED DESCRIPTION OF THE PREFERRED EMBODIMENTS

Figure 1:
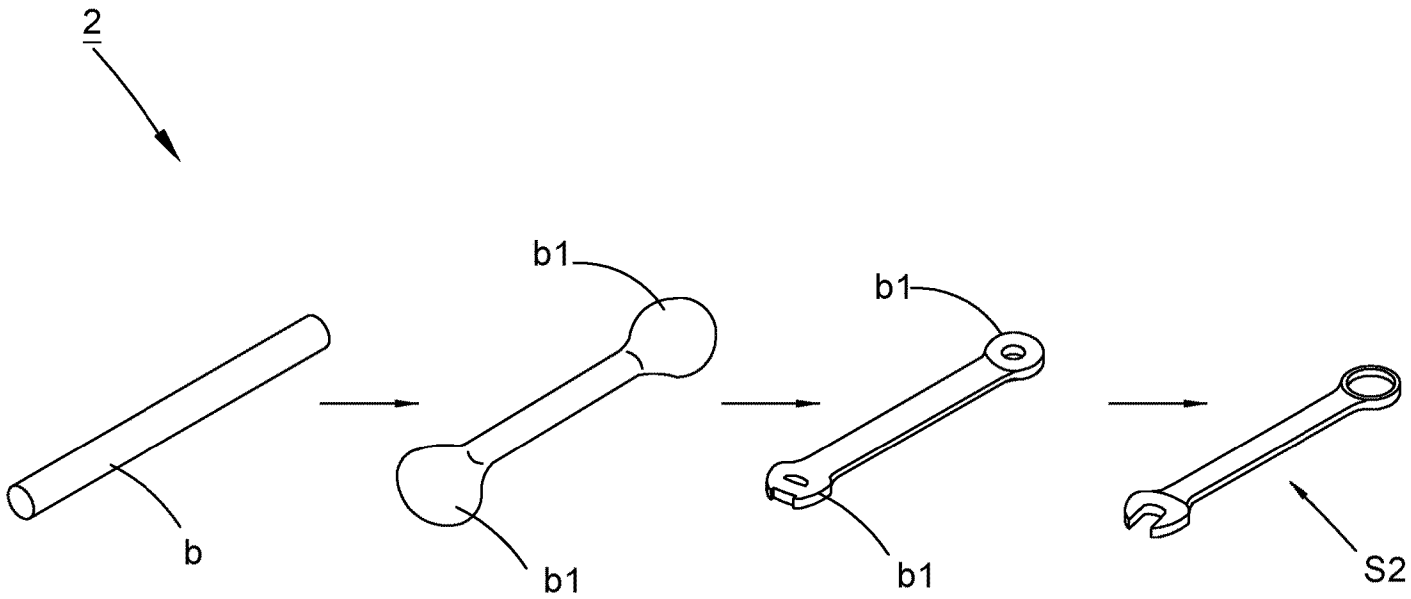
FIG. 1 (PRIOR ART)
FIG. 1 is a schematic view showing a conventional method.
Figure 2:
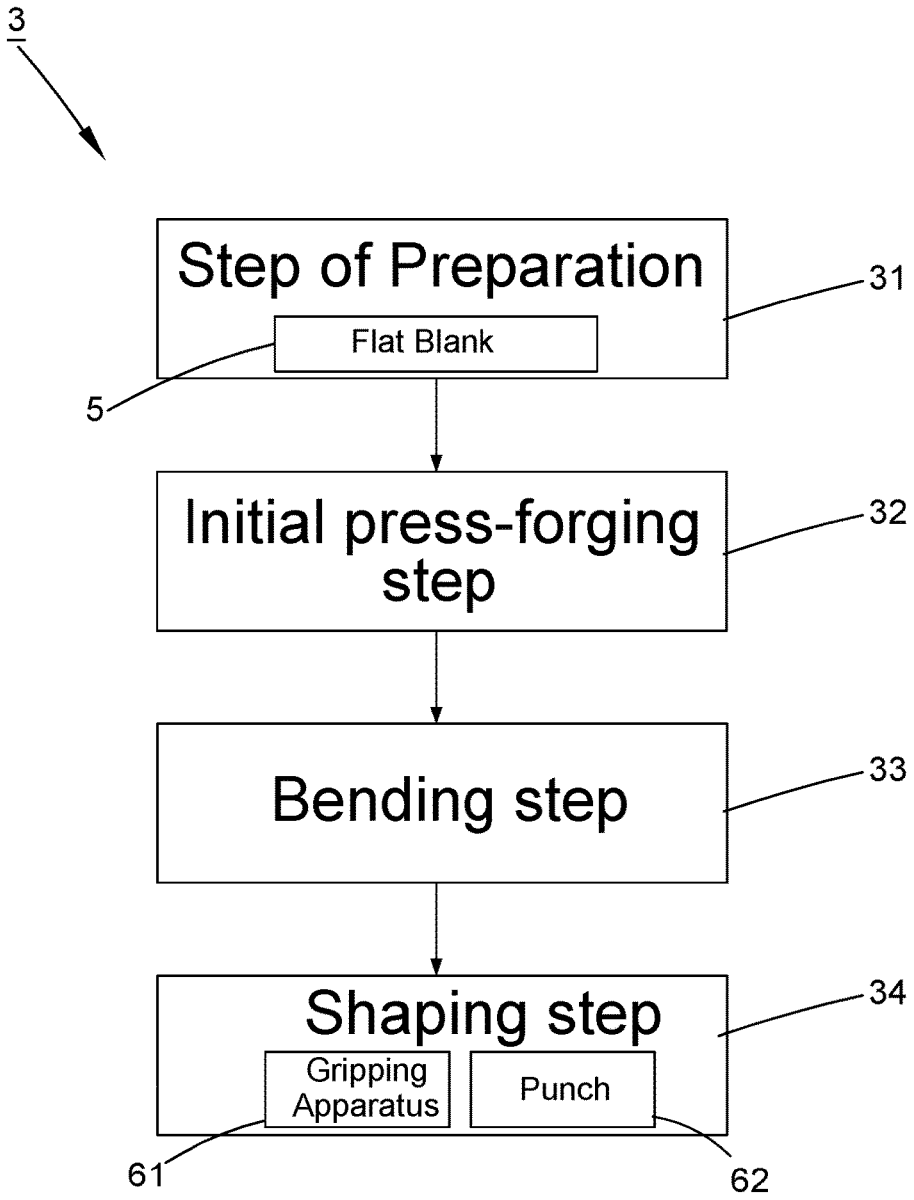
FIG. 2 is a block diagram showing the steps of a first preferred embodiment of this invention in sequential order.
Figure 3:
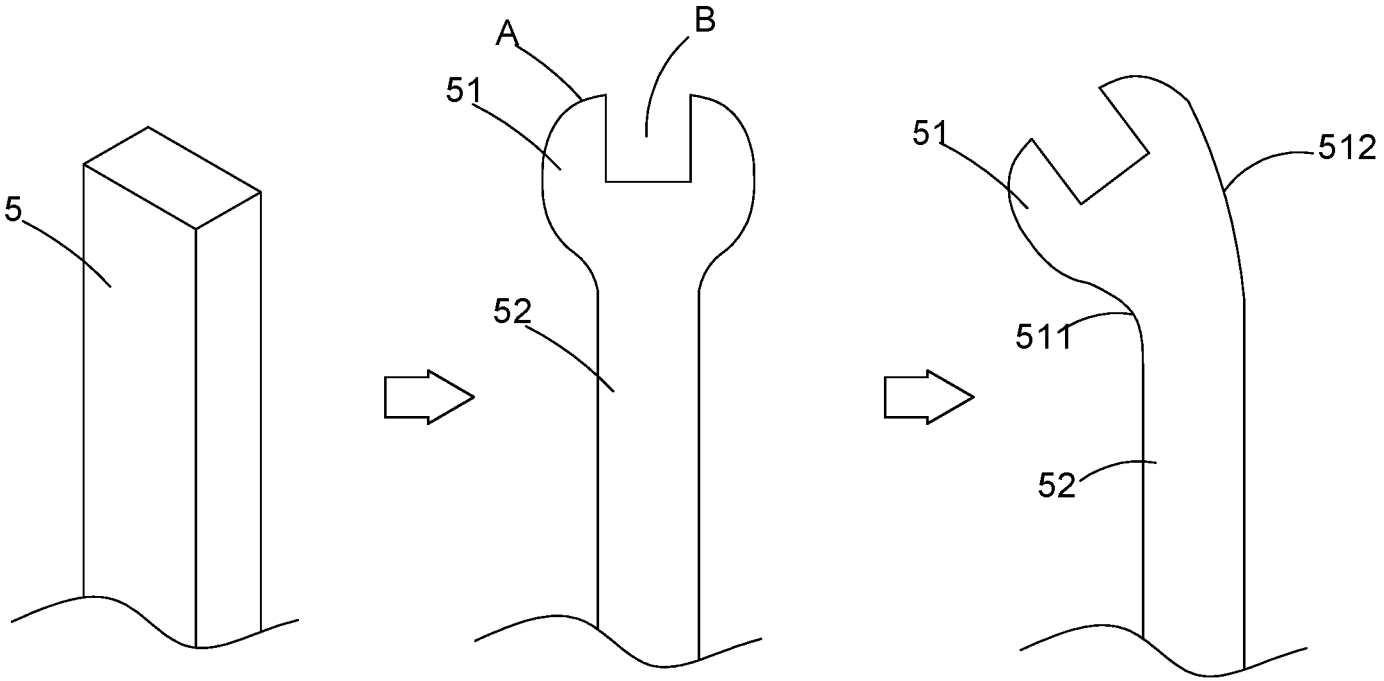
FIG. 3 is a schematic view showing partial steps of the first preferred embodiment of this invention in sequential order, including the step of preparing a flat blank, the step of initially press-forging at least one end of the flat blank, and the step of bending the head.

Referring to FIG. 2, a method 3 for forming a wrench end of a first preferred embodiment of this invention includes a step of preparation 31, an initial press-forging step 32, a bending step 33 and a shaping step 34. As shown in FIG. 3, the step of preparation 31 is performed by preparing a blank 5. The blank 5 is in a flat shape, preferably in a rectangular and level contour as shown, thereby being conducive to a direct pressing action. After the preparation step 31, the step 32 is performed by initially press-forging at least one end of the flat blank 5 in order to divide the flat blank 5 into a head 51 and a shank 52 extending outwards from the head 51. Specifically, the head 51 is pressed to have a wrench-shaped part A and also form a hole B while the wrench-shaped part A is formed. In the embodiments of this invention, only the end of the blank 51 is pressed to form the head 51, and the non-pressed remainder of the blank 51 is configured for the shank 52 extending from the head 51. In the initial press-forging step 32, the wrench-shaped part A and the hole B are formed at the same time. Preferably, the wrench-shaped part A can have an arch-shaped edge constructing the contour of the wrench, and the hole B can be open or not open to an outside.

Figure 4A:
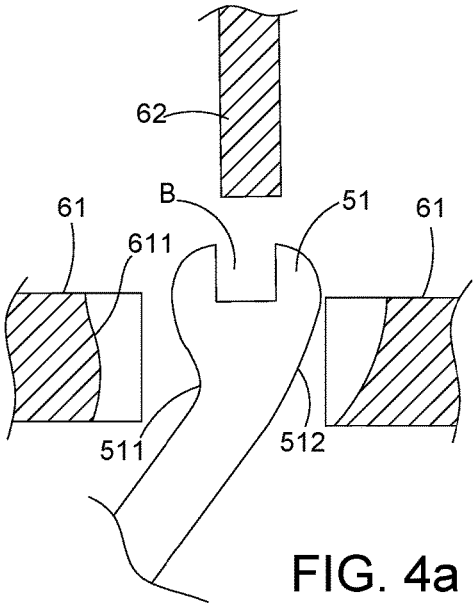
FIGS. 4A-4D are schematic views showing the shaping step of the first preferred embodiment of this invention.
Figure 4B:
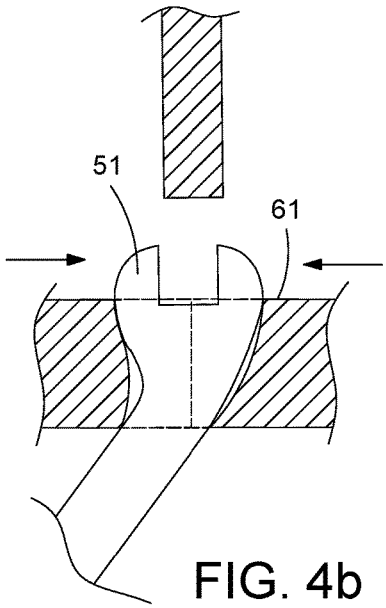
Figure 4C:
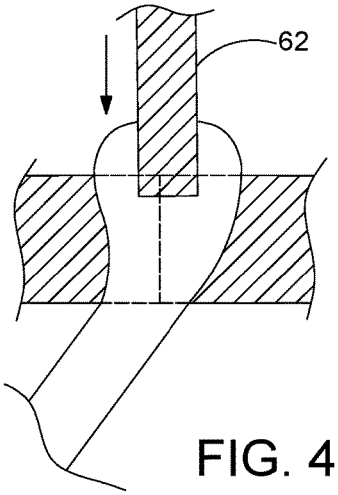
Figure 4D:
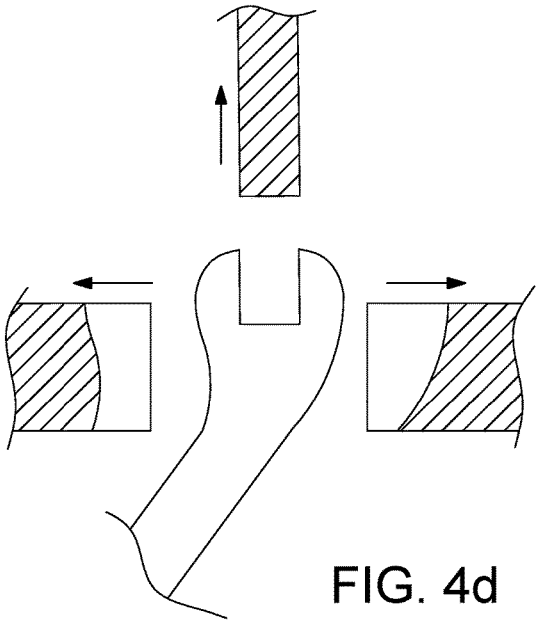

Still referring to FIG. 3, after forming the head 51 with the wrench-shaped part A and the hole B, the bending step 33 is executed. The step 33 is performed by bending the head 51 with a bending device (not shown). In other words, the head 51 is bent so that the head 51 can be inclined to the shank 52 by an angle and two side surfaces where the head 51 and the shank 52 are joined form a curved section 511 and a stretched section 512 respectively which are bent by different angles. As shown in the figure, one side surface of the head 51, namely an inner side, is bent to define the curved section 511, and the other side surface thereof, namely an outer side, is bent and stretched to define the stretched section 512. After the bending action, the shaping step 34 is executed. The step 34, as shown in FIGS. 4*a*-4*c*, is performed by preparing a gripping apparatus 61 with grip faces 611 serving to hold the curved section 511 and the stretched section 512 in place and a punch 62 located relative to the gripping apparatus 61 and then squeezing the head 51 enclosed by the gripping apparatus 61 gradually when the punch 62 presses the hole B of the head 51. Therefore, the curved section 511 and the stretched section 512 become squeezed and converged gradually and have a change in their interior structure under the pressing action of the punch 62 in combination with the surrounding behavior of the grip faces 611 of the gripping apparatus 61, thereby allowing the two side surfaces of the head 51 and the hole B to be well shaped into a desire appearance. Thereafter, the blank 5 is withdrawn from the gripping apparatus 61, as shown in FIG. 4*d*.

The operation of this invention is described with the aid of FIGS. 2-3. First, a flat blank 5 is prepared. This flat blank 5 allows the end of the blank 5 to be directly press-forged in the following step 32. The direct press-forging action can shorten the processing time, promote the efficiency of production and reduce waste material during the processing operation. In the initial press-forging step 32, a wrench-shaped part A and a hole B are concurrently formed on the head 51 of the blank 5. The head 51 is then bent toward one side to form a curved section 511 and a stretched section 512 which are bent by different angles. Particularly, because the stretched section 512, at the outer side, is bent and spread, this section becomes loose. In other words, the interior structure of the stretched section 512 is not compact or not tight when it is bent and stretched. After the bending step 33, the curved section 511 and the stretched 512 of the head 51 are enclosed by a gripping apparatus 61, thereby holding the head 51 in position, as shown in FIG. 4*b*. Then, a punch 62 is directed to the hole B of the head 51 for pressing. The pressing action of the punch 62 causes the remainder of the head 51 to come toward the curved section 511 and the stretched section 512. This action results in a change in the density of the interior structure of the two sections. In other words, the head 51 enclosed by the gripping apparatus 61 is forced by the pressing force, and the arrangement of the interior structure of the curved section 511 and the stretched section 512 become compact and tight to provide the head 51 with a denser performance. The curved section 511 and stretched section 512 at two opposite side surfaces of the head 51 are squeezed until the shapes of the sections 511, 512 fit in with the grip faces 611 of the gripping apparatus 61. Therefore, a final contour of the wrench-shaped part A can be shaped. Further, residual materials left in the hole B can be concurrently removed when the punch 62 presses the hole B directly. Therefore, a final contour of the hole B can also be shaped, as shown in FIG. 4*c*. The shaping step 34 is thence completed to attain the effect of forming the wrench end quickly.

The steps 31,32,33,34 executed in successive order allow the wrench-shaped part A and the finished hole B to be formed on the head 51 of the blank 5 at the same time and are distinguished in comparison with the traditional steps of forming the wrench outline and hole sequentially and finally removing residual material from the outline. Therefore, the efficiency of processing the wrench is largely promoted, and the shape of the wrench end can be quickly formed. The shaping step 34 can subject the partial bent portions of the head 51 to a pressing force whereby the interior structure of the head becomes compact under the squeezing action to provide a denser performance, and therefore the quality of the formed wrench is increased.

Figure 5:
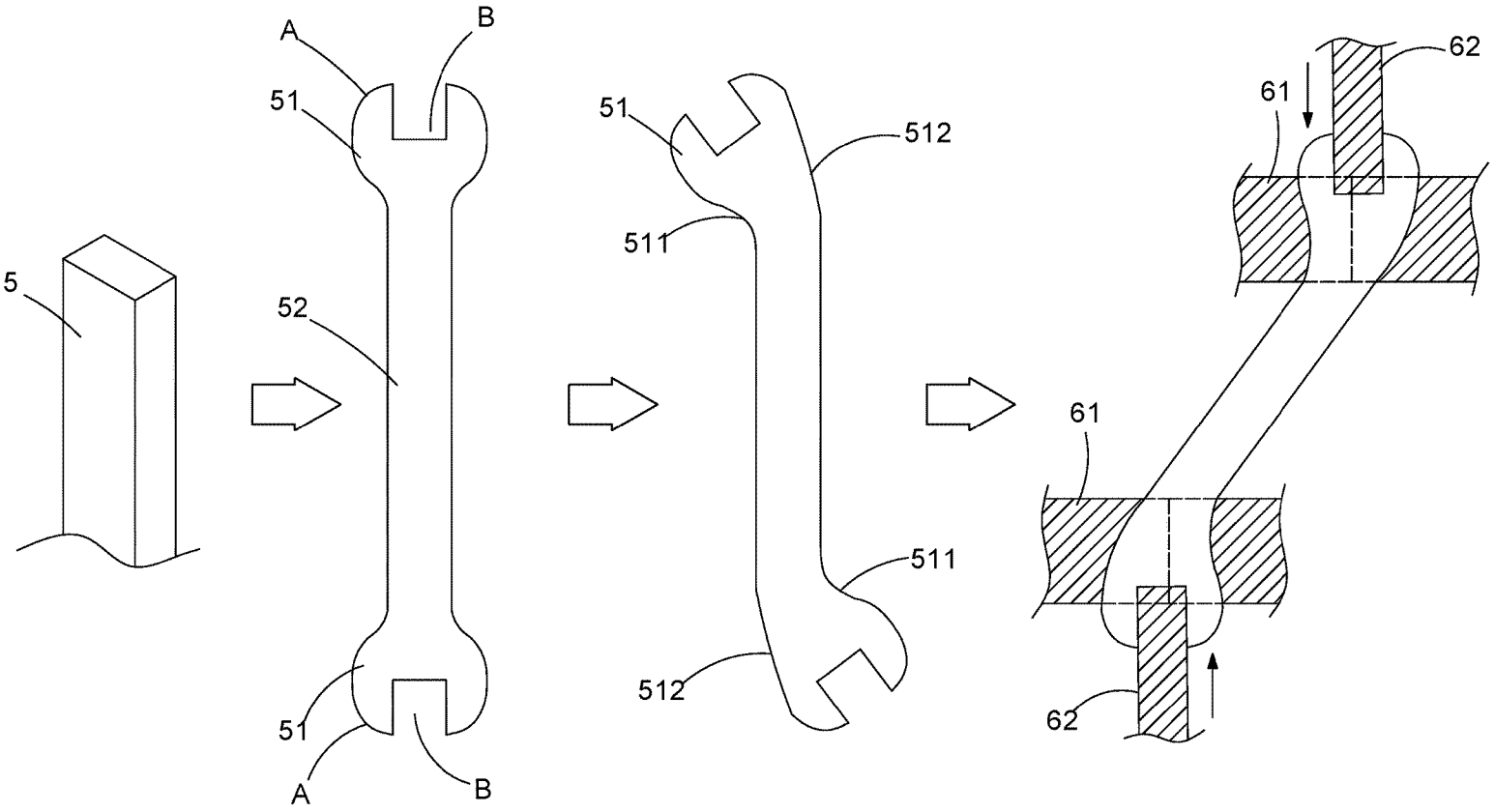
FIG. 5 is a schematic view showing the steps of a second preferred embodiment of this invention in sequential order.

Referring to FIG. 5, a method 3 for forming a wrench end of a second preferred embodiment of this invention still includes a step of preparation 31, an initial press-forging step 32, a bending step 33 and a shaping step 34. The concatenation of correlated elements, operations and objectives of this preferred embodiment are the same as those of the first preferred embodiment and herein are omitted. The second preferred embodiment is characterized in that the initially press-forging step 32 is performed by press-forging two ends of the flat blank 5 at the same time, thereby forming two opposite heads 51 with respective wrench-shaped parts A and holes B. This task shortens the processing time, promotes the efficiency of production and reduces waste material during the processing operation. Furthermore, the bending step 33 can bend the two heads 51 of the blank 5 at the same time or in sequential order, thereby providing the heads 51 with respective curved sections 511 and stretched sections 512 bent at different angles. In this embodiment, it is taken as an example that the two heads 51 are bent at the same time, as shown. Finally, in case of two heads 51, the curved section 511 and stretched section 512 of each head 51 can be held by the gripping apparatus 61 and then be gradually squeezed under a pressing force of the punch 62 imparted to the hole B of each head 51. Then, the curved sections 511 and the stretched sections 512 have a change in their interior structures respectively to provide a denser arrangement. Accordingly, these sections 511,512 and the holes B can be well shaped to provide the heads 51 with respective final shaped appearances. The successive steps go smoothly to promote the forming efficiency, attain a denser interior structure for the wrench end and increase the forming quality of the wrench product.

To sum up, the method of this invention includes steps of preparing a flat blank, initially press-forging at least one end of the blank to form a head with a wrench-shaped part and a hole on the blank, bending the head to form a curved section and a stretched section bent at different angles, and holding the curved section and the stretched section in place with a gripping apparatus and pressing the hole with a punch in order to subject the two sections to a squeezing force whereby the remainder of the head converge toward the sections to have a denser interior structure and thence complete the task of shaping the head. The method facilitates a quick shaping of the wrench end and increases the efficiency of forming a wrench product.

While the embodiments of this invention are shown and described, it is understood that further variations and modifications may be made without departing from the scope of this invention.

What is claimed is:

1. A method for forming a wrench end comprising steps of:

preparing a flat blank;

press-forging at least one end of said flat blank to divide said flat blank into a head and a shank extending from said head, said head being pressed to form a wrench-shaped part and concurrently form a hole at the time of forming said wrench-shaped part;

bending said head to make said head incline to said shank and cause said head to form a curved section and a stretched section which are respectively formed at two side surfaces where said head and said shank are joined and are bent to be angularly offset one from the other; and surrounding and holding said curved section and said stretched section in place with a gripping apparatus and using a punch located relative to said gripping apparatus to press said hole, said curved section and said stretched section enclosed by said gripping apparatus being squeezed gradually when said punch presses said hole to provide a final shape to said head.

2. The method according to claim 1, wherein said press-forging step is performed by press-forging two ends of said flat blank at the same time to provide said flat blank with two opposite heads with respective wrench-shaped parts and holes.

3. The method according to claim 2, wherein said bending step is performed by bending said two heads relative to said shank to angularly offset said two heads with respect to said shank.

4. The method according to claim 3, wherein said shaping step is performed on said two heads to provide respective final shapes to said heads.

* * * * *